United States Patent [19]

Hunter

[11] Patent Number: 4,586,841

[45] Date of Patent: May 6, 1986

[54] SUSPENDED CEILING

[76] Inventor: Richard P. Hunter, 373 Davisville Avenue, Toronto, Ontario, Canada

[21] Appl. No.: 616,251

[22] Filed: Jun. 1, 1984

[51] Int. Cl.[4] ..... E04B 5/52; E04C 2/42

[52] U.S. Cl. ..... 403/230; 52/668; 52/282

[58] Field of Search ..... 52/729–732, 52/241, 282, 464, 738, 484, 667, 668; 403/230, 245, 242, 252

[56] References Cited

U.S. PATENT DOCUMENTS

| | | | |
|---|---|---|---|
| 2,286,976 | 6/1942 | Roberts | 52/484 |
| 2,728,957 | 1/1956 | Keller | 52/281 |
| 2,888,113 | 5/1959 | Schwartz et al. | 52/484 |
| 2,946,414 | 7/1960 | Gordon et al. | 52/484 |
| 3,001,001 | 9/1961 | Bibb | 52/484 |
| 3,031,042 | 4/1962 | Drackett | 52/484 |
| 3,185,833 | 8/1966 | Blitzer . | |
| 3,263,388 | 8/1966 | Bogert | 52/665 |
| 3,265,879 | 8/1966 | Ford et al. . | |
| 3,275,817 | 9/1966 | Schwartz et al. | 52/484 |
| 3,292,332 | 12/1966 | Jahn | 52/484 |
| 3,304,684 | 2/1967 | Mock et al. | 52/665 |
| 3,305,256 | 2/1967 | Znamirowski | 52/665 |
| 3,327,438 | 6/1967 | Cooper | 52/282 |
| 3,333,387 | 8/1967 | Deakins | 52/664 |
| 3,340,662 | 9/1967 | Deinhart et al. | 52/476 |
| 3,378,976 | 4/1968 | Meredith | 52/573 |
| 3,396,997 | 8/1968 | Adams | 52/484 |
| 3,440,947 | 4/1969 | Averill | 403/230 |
| 3,451,183 | 6/1969 | Lespagnol et al. | 403/230 |
| 3,844,086 | 10/1974 | Radtke | 52/464 |
| 3,846,031 | 11/1974 | Adams | 52/484 |
| 3,877,193 | 4/1975 | Hall | 52/729 |
| 3,898,782 | 8/1975 | Donato | 403/230 |
| 3,965,632 | 6/1976 | Rousey | 52/232 |
| 3,989,399 | 11/1976 | Slowbe | 52/241 |
| 4,043,689 | 8/1977 | Spencer et al. | 52/667 |
| 4,086,480 | 4/1978 | Zahn | 248/343 |
| 4,114,327 | 9/1978 | Williams | 52/664 |
| 4,316,352 | 2/1982 | Harrington et al. | 52/731 |

FOREIGN PATENT DOCUMENTS

| | | | |
|---|---|---|---|
| 841379 | 7/1960 | United Kingdom | 52/729 |

*Primary Examiner*—James L. Ridgill, Jr.
*Attorney, Agent, or Firm*—Ivor M. Hughes

[57] ABSTRACT

Improved connection or joint for members of a grid system used, for example, for suspending a suspended ceiling and a process for forming the joint.

2 Claims, 12 Drawing Figures

FIG. 10.
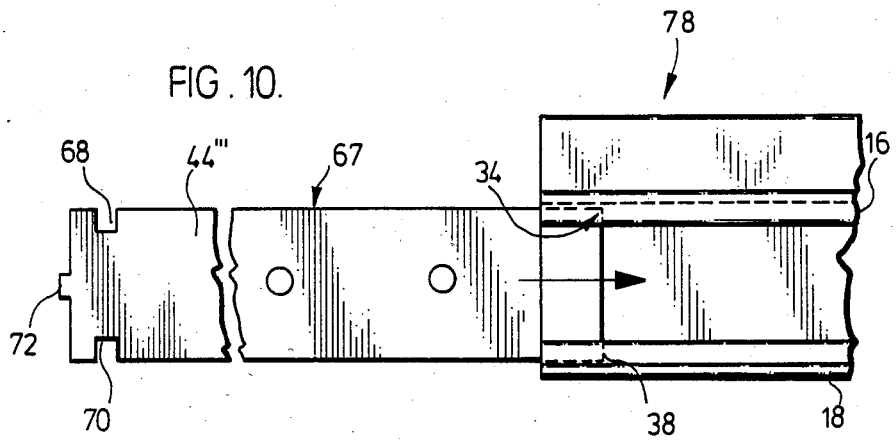
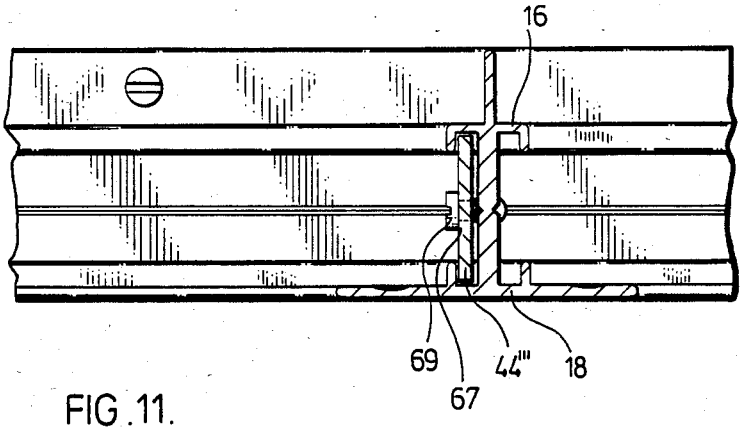
FIG. 11.

SUSPENDED CEILING

FIELD OF INVENTION

This invention relates to an improved connection or joint for members of a grid system used, for example for suspending a suspended ceiling and a process for forming the joint.

BACKGROUND OF INVENTION

Grid systems for a suspended ceiling are customarily composed of a plurality of horizontal members intersecting one another at right angles so as to form a uniform grid. Some of the members or components making up the grid system are usually suspended from vertical hangers attached to the structural ceiling while some of the peripheral components are secured directly to the vertical walls defining the peripheral extent of the system. Such system is also customarily used to conveniently support electrical fixtures and wiring, heating and air conditioning vents or virtually any other suitable components to be interposed in the suspended ceiling.

Components of the system usually carry support flanges for supporting ceiling panels or tiles in the grid to present an aesthetically pleasing noise reducing ceiling and separate the room environment from the space between the structural ceiling and suspended ceiling. In some instances the panels are sealed to the flanges to seal the space from one another.

Customarily, the process of assembling or suspending the horizontal members of a suspended ceiling involves two steps:

hanging the members from a structural ceiling; and connecting the grid members, where they intersect to each other and to any walls.

Until my invention, the process for connecting the horizontal members to each other and to a wall, and the actual connection, have both been relatively complex, not lending to ease of assembly and disassembly. For example, a number of grid systems have been proposed involving vertical natches permitting one member to overlay another member and be carried in the notches (as shown in for example U.S. Pat. Nos. 3,031,042; 3,263,388; 3,001,001; 3,965,632; 3,304,684; and 4,114,327) and slots through the components for receiving connectlng shafts. tabs or tongues extending longitudinallly from the ends of other components positioned at right angles and tabs or connectors overlying or abutting intersecting members securing them together (as shown in for examplle U.S. Pat. Nos. 4,043,689; 2,286,976; 3,333,387; 3,292,332; 2,888,113; 4,086,480; 3,396,997; 3,305,256; 3,340,662; 3,265,879; 3,846,031; 3,185,833; 3,333,387; 3,378,976; 3,275,817 and 2,946,414). The drawbacks of these methods are that they, may require tools specifically designed for the system for assembly, do not permit simple or quick assembly and disassembly, may require the fabrication of additional connecting parts and may require comparatively detailed machining of the members to accommodate the various vertical notches, slots or tabs.

U.S. Pat. No. 2,728,957 discloses moulding strips each carrying a longitudinal channel having lips extending from the top and bottom edges of the channel towards the other lip and a groove to receive the edges of a flat sheet (for example, a counter, table, etc.) above the longitudinally extending groove. A support is secured in the longitudinal channel by sliding it down the length of the channel until in the desired position.

It is therefore an object of this invention to provide improved components suitable for use to form an improved joint suitable for use to assemble an improved ceiling grid system and an improved method of assembling the grid system.

Further and other objects of the invention will be apparent to those skilled in the art from the following summary of the invention and detailed description of embodiments thereof.

SUMMARY OF INVENTION

According to one aspect of the invention, an extrusion member is provided suitable for forming an improved joint comprising a vertically extending web, at least a pair of flanges spaced from one another and extending from one side thereof away from the web, one lip extending from each flange towards the other flange to define a channel between the lips and web and a support flange carried by one end of the web extending laterally from the web beyond the width of the channel.

According to another aspect of the invention the web may carry a centrally disposed channel having a bed therein, the channel opening in a direction away from the side of the web from which the flanges and support flange extends. Preferably the channel carries centrally disposed apertures through the bed at spaced predetermined intervals in the bottom.

According to another aspect of the invention, the web may have a pair of flanges spaced from one another extending from the other side of the web (preferably aligned with the other flanges), one lip extending from each such flange towards the other flange and aligned with the lip on the other flange to define a channel between the lips and web of the same dimensions as the other channel and a support flange carried by the web comprising an extension of the support flange on the other side of the web and extending laterally beyond the width of the channel on the other side of the web.

Preferably the channels are all of equal width. According to another aspect of the invention, the flange proximate the support flange from which flange, the lip extends, and the support flange may coincide and the lip extends from a position intermediate the width of the flange towards the other flange.

According to another aspect of the invention, the support flange may carry a depression or trough along its length intermediate that portion laterally beyond the lateral extent of the channel and outer edge of the support flange.

According to another aspect of the invention, an extrusion member is provided comprising a vertically extending web, a pair of colinear flanges extending laterally from one end of the web from either side, each flange carrying a lip upstanding from a position intermediate its outer edge and the web to define a pair of like channels, and a pair of colinear laterally extending flanges extending from the web spaced from the other flanges and carrying a pair of lips aligned with, and directed towards, the other lips to define a pair of channels having the same dimensions as the other channels, the colinear flanges extending laterally from one end of the web. Preferably spaced apertures are provided along the length of the web.

According to another aspect of the invention, the extrusion member having flanges extending from both sides of the web, may have its end modified to present a longitudinally extending web having a leading edge and of material of a width greater than the space between the lips of the pair of opposed spaced flanges but less than the distance between the bottoms of the opposed channels, each such web carrying (i) a centrally disposed projection (locating pin) extending longitudinally from the leading edge of the web away from the web, and (ii) a pair of aligned notches in the web, one in each side edge of the web to accommodate a lip of each pair of opposed lips defining the opposed channels, each notch being spaced from the leading edge by a distance equal to the width of the channel it must accommodate when the lip defining the extent of the channel is carried in the notch, the portion of each web extending from the modified end of the extrusion member not carrying any flange portion therebelow for a distance from the leading edge of the modified end of the extrusion member equal to the width of the support flange of another member to which it will be secured.

According to another aspect of the invention the extrusion member may itself be modified to carry such modification.

According to another aspect of the invention, the extrusion member may carry a separate member which provides such modification as for example by being fastened to the web of the extruded member as by screws, the modification comprising a web having a leading edge and a width greater than the distance between opposed lips but less than the width between the distance between the bottoms of opposed channels, the modification carrying a pair of notches in its side edges to receive the opposed lips and each notch spaced from the leading edge by a distance to accommodate the channel proximate the lip to be carried by the notch, and the leading edge carrying a projection (locating pin) extending longitudinally of the plane of the web away from the web.

Therefore, according to another aspect of the invention, by connecting these components by inserting the projections on the leading edges of the modified portions of the extrusions into the apertures of other members previously suspended from the structural ceiling and by inserting the lips into the respective notches, a grid for supporting ceiling tile can be created as required. For ease of assembly, this invention provides a novel process for connecting the members. In this regard, when a pair of members are disposed with the place of the webs of the members materially angled to one another so that there is a horizontal component to such angular disposition, and the projection (locating pin) on the leading edge of the web of one modified extrusion member is inserted through an aperture in the web of another extrusion member (whether through the aperture in web or channel carried by the web), and the plane of the web, rotated, the lips become lodged in the notches locking the members together in a predetermined position. Therefore, according to another aspect of the invention, a process for connecting two members is provided, one member carrying a web having two sides and a leading edge, a projection carried by the leading edge of the web, a pair of notches opening through both sides, one through each side, and spaced from the leading edge by a predetermined distance, the other member comprising a web, a pair of flanges extending from one side of the web and spaced from one another by a distance at least equal to the width of the web of the first member, each of the flanges carrying a lip extending towards the other flange by a distance equal to the depth of the notch and defining a channel with the web opening towards the other flange of a width to permit the notch to receive the corresponding lip when the members are secured together, the web having an aperture therein for receiving the projection, the process comprising the steps of:

(1) bringing the members together with the plane of the webs angled vertically with respect to one another;

(2) inserting the projection of one member through the aperture of the other:

(3) rotating at least one of the members to position the planes of the webs to extend vertically parallel to one another whereby the notches receive the lips thereby locking the two members together.

Thus the joint formed comprises the projection on the one member extending through the aperture through the web of the other member and the notches of the one member receiving the lips of the other member. By assembling the various components as described a grid system of the components is assembled. By securing the tiles on the flanges with glue carried in the depressions or troughs in the flanges, the ceiling tiles can be permanently secured to the members until the bond is destroyed.

The extruded members, preferably comprise aluminum (best for commercial purposes) or plastics material (for residential purposes, where strength may not be as important). Therefore by using the components of the invention to form a grid, a ceiling that is impervious to the migration of dust, air or corrosive contaminants, from either above or below the ceiling may be provided by utilizing support flanges of the extruded member carrying the recess or depression for carrying a sealant between the support flange and overlying ceiling panels. This is useful wherever particularly clean or sterile room environments are required. For example, in food processing plants it is common for the ambient environment to expose the ceiling to chlorine, salt, excessive humidity in the air and temperatures of 40 to 50 degrees F. making a corrosive environment. In such an environment the ceiling tile overlies and forms a seal with the lip of the supporting flange to seal the rool from the infiltration of contaminants originating above the ceiling. Because this environemt necessitates the dismantling of the ceiling and washing the ceiling tiles and supporting extrusion members from time to time, the use of extrusion members made of aluminum are ideally suited for this application.

BRIEF DESCRIPTION OF THE DRAWINGS

The invention will now be illustrated with reference to the following drawings:

FIG. 10 is a schematic view of the formation of a modified extrusion member according to an embodiment of the invention.

FIG. 11 is a cross-sectional view taken along the line 11—11 in FIG. 7 looking in the direction of the arrows.

DETAILED DESCRIPTION OF EMBODIMENTS OF THE INVENTION

Figure 1:
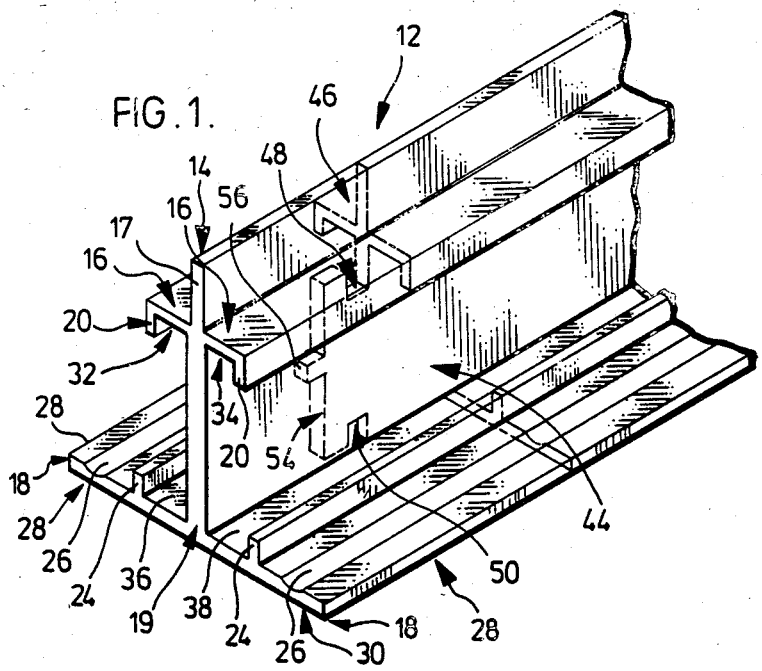
FIG. 1 is a perspective view of an unmodified extrusion member illustrating a modification that may be made to the member (shown dotted) for use according to one embodiment of the invention.

With reference to FIG. 1 there is shown an extrusion member 12 of aluminum comprising a vertically extending web 14 having a pair of colinear laterally extending flanges 16 proximate the top 17 of web 14 and a pair of colinear laterally extending support flanges 18 at the bottom 19 of web 14. Each of flanges 16 are of equal width as are flanges 18. Each of flanges 16 carries a vertically downwardly extending lip 20 of its side edge. Each support flange 18 carries a vertically upwardly extending lip 24, a predetermined distance from web 14. Each support flange 18 also carries a longitudinally extending depression or recess 26 intermediate lip 24 and the outer side edge 28 of flange 18. Lips 20 and 24 and web 14 together present U-shaped longitudinal channels 32, 34, 36, 38 respectively having as their bottoms, flanges 16 and 18, as the case may be.

Figure 2:
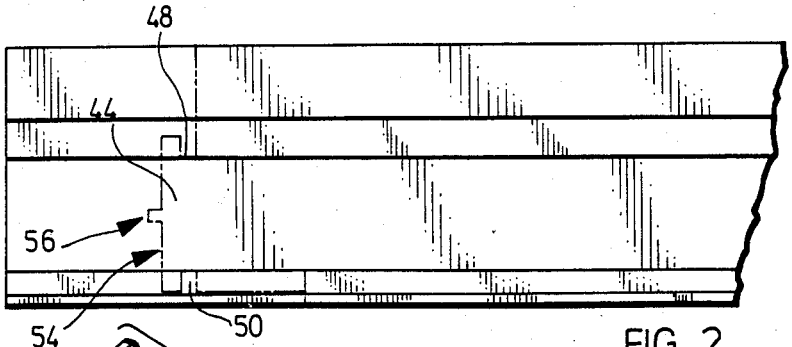
FIG. 2 is a side view of the unmodified extrusion member and the proposed modifications shown if FIG. 1 (dotted).

With reference to FIGS. 1 and 2, extrusion member 12 may be modified by the removal of material along the dotted line to present web portion 44 extending from one end of the extrusion 12 by the removal of portions of flanges 16 and 18, lips 20 and 24, and web 14. The resultant "exposed" vertical web portion 44 or "key" therefore carries notches 48 and 50 a predetermined distance from the leading edge 54 of web portion 44. A projection or locating pin 56 is carried on the leading edge 54. Web portion 44 is of the same width in all extrusions as the width of web 14 between flanges 16 and 18.

Figure 3:
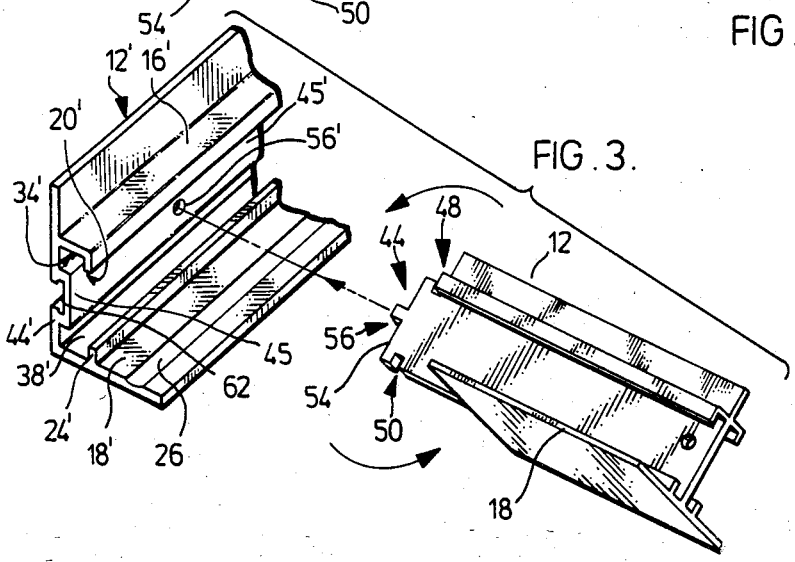
FIG. 3 is a perspective view of modified extrusion members according to an embodiment of the invention and illustrates a method of forming a connection therebetween.

With reference to FIG. 3, "key" 44 of member 12 is designed to secure member 12 to another member 12'. Member 12' comprises modified central web 44' carrying laterally opening channel 45 having bed 45' having a pair of longitudinally extending channels 34', 38' defined by flanges 16' and 18', web 44' and lips 20' and 24', lips 20' and 24' spread over from web 44' and particularly portion 45' by a distance equal to the distance between leading edge 54 and notches 48 and with each notch 48 and 50 being of a size to secure lips 20' and 24' therein.

As will be seen in FIG. 3, the two components may be joined by inserting projection 56 into aperture 56' through bed 45' with both webs angled out of vertical alignment with one another as shown and by rotating the extrusions to bring both webs into a position to extend vertically the notches 48 and 50 and receive and secure lips 20' and 24'.

The reader will note that web portion 44' has a greater portion of flange 18 removed from its side edge than flange 16. This is to permit flange 18 of member 12 to abut flange 18' of extrusion member 12' when the two are secured together.

Figure 4:
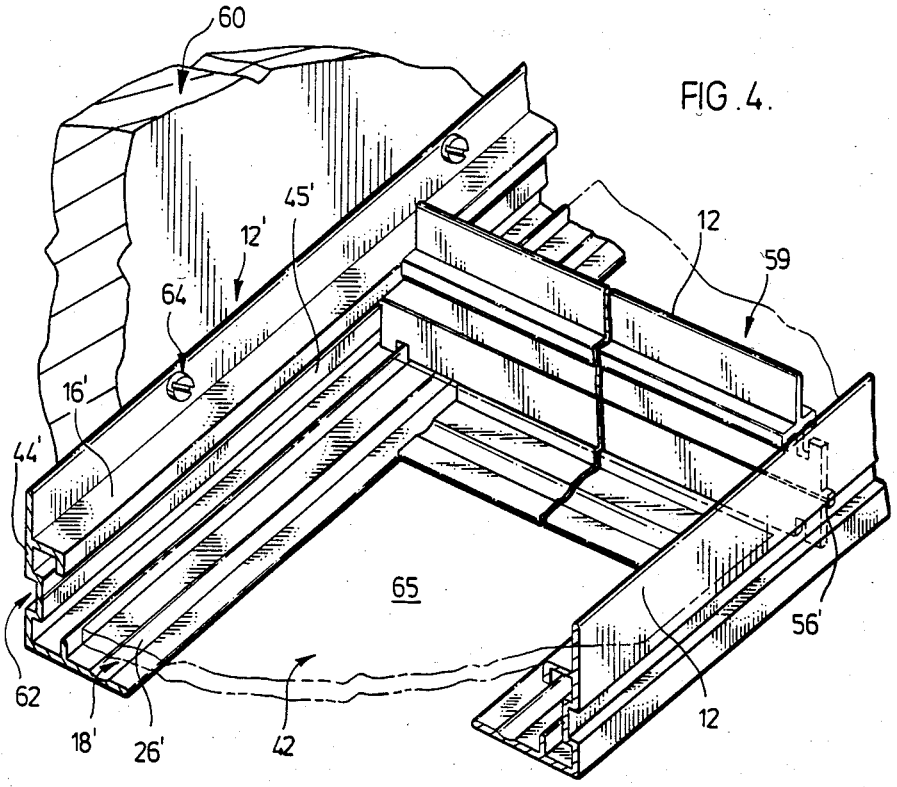
FIG. 4 is a perspective view of a portion of a grid system formed by connecting the modified extrusion members of FIG. 3.
Figure 6:
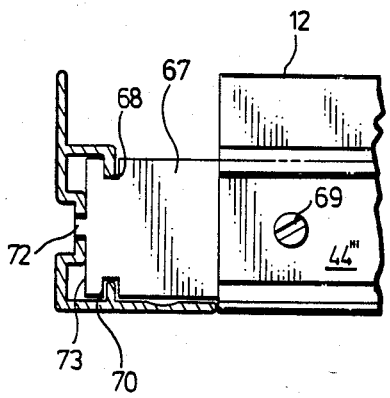
FIG. 6 is a side view of a similar connection as in FIG. 5 comprising modified extrusion members according to another embodiment of the invention.
Figure 5:
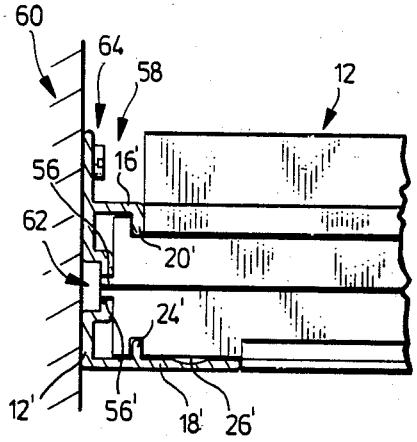
FIG. 5 is a side view of the connection shown in FIG. 4.

For the purposes of assembling a grid system, extrusion member 12' is anchored to the wall by screws 64 (see FIG. 4) and members 12 are secured to it. Other members 12 are then mounted utilizing the apertures 56' in web 14 of members 12 as shown in FIG. 4. Because extrusion 12' is mounted against wall 60, web 44' of extrusion 12' carries laterally opening channel 62 opening away from flanges 16' and 18'. Apertures 56' extending through portion 45' are spaced from wall 60 to receive projection 56 extending through aperture 56' and permit any portion of projection 56 extending past bed 45' of channel 45 to be accomodated. (see FIG. 5). The other end of member 12 is secured to for example another member 12' in like manner. Intermediate the length of member 12, other transverse members 12 are secured to member 12 in the manner shown in FIG. 4, to continue to erect the grid system. Once the grid system is erected, tile 65 is positioned on flanges 18 and 18' and secured by sealant carried in depressions 26 and 26' to the members 12 and 12'.

Figure 4A:
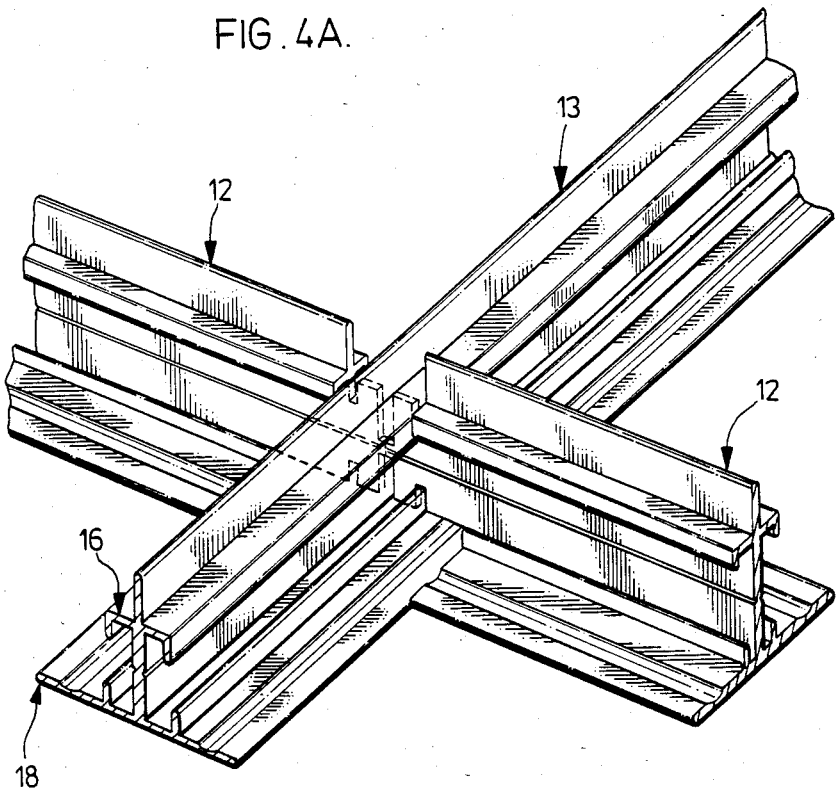
FIG. 4A is a perspective view of a portion of the grid system formed by connecting an unmodified extrusion member carrying flanges either side of the web shown in FIG. 1, with a modified extrusion member carrying flanges either side of the web shown in FIG. 3.
Figure 7:
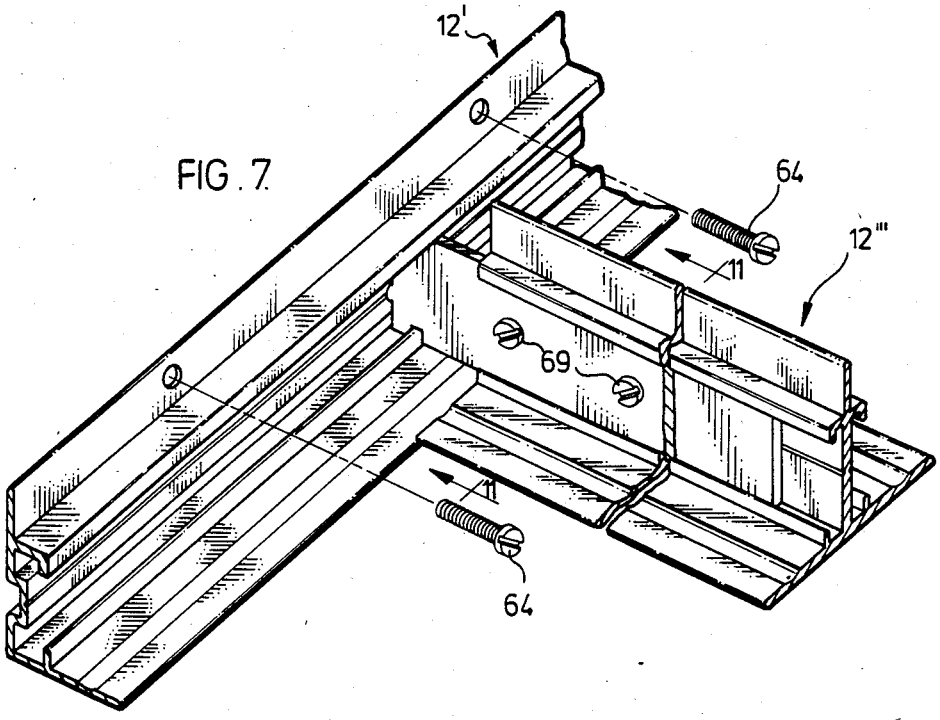
FIG. 7 is a perspective view of a portion of a grid system formed by connecting the modified extrusion members shown in FIG. 6, according to another embodiment of the invention.
Figure 8:
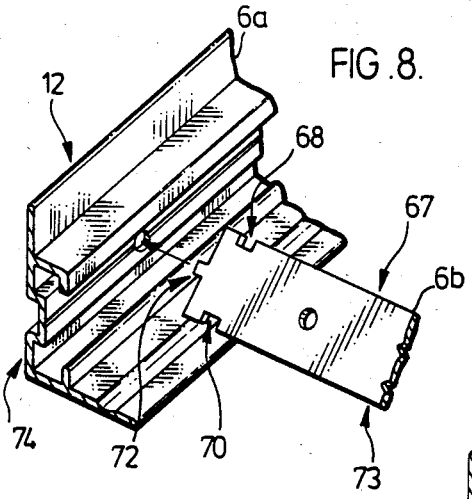
FIGS. 8 and 9 are perspective views illustrating the formation of the connection between the components shown in FIG. 7.
Figure 9:
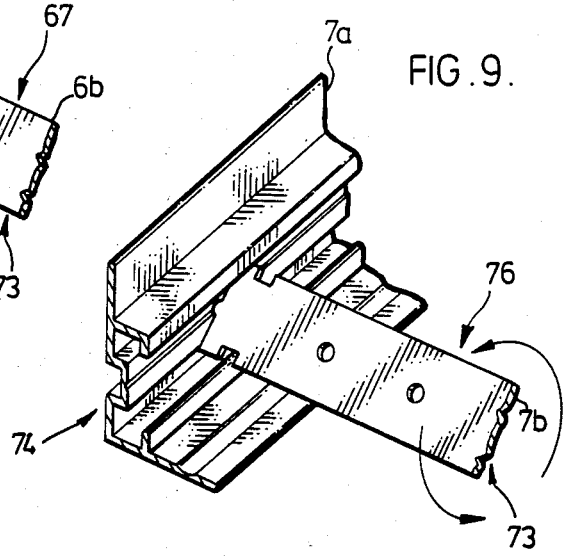

With reference to FIG. 4A, extrusion member 13' comprises an unmodified extrusion member as shown in FIG. 1 and extrusion member 12 comprises a modified extrusion member. Because extrusion member 13' is not adapted to be anchored to the wall, but rather is adapted to form a connection intermediate the length of extrusion member 12, it carries a pair of colinear laterally extending flanges 16, 18. Modified extrusion members 12 are secured to member 13' to continue to erect the grid system.

With reference to FIGS. 6 through 11 inclusive, the extrusion of FIG. 1 has not been modified to provide the desired profile 44 by the removal of portions of the web 14 or flanges 16 and 18. Rather an insert or "modular key" 67 has been provided for securing to web 14 of member 12 by screws 69 to permit key 16 to act in the same manner as the modified portion 44. Particularly insert 67 comprises web 44 to be accommodated between flanges 16 and 18 in channels 34 and 38 or 32 and 36. (see FIG. 10). Web 44 carries notches 68 and 70 on the top and bottom, and projection or locking pin 72 extending longitudinally from the leading edge 73 of modular key 67. Modular key is connected to an extrusion member 12 by screws 69 to extend from member 12 by a distance equal to the width of flange 18' or 18 to permit flange 18 and 18' or 18 and 18' to abut when the members are secured together. As is apparent from FIGS. 6 to 11 inclusive, once key 67 is secured to extrusion member 12, the modified member is secured to another extrusion 12, 12' or 13' in the same manner as member 12. (See FIGS. 8, 9 and 7).

As many changes can be made to the embodiments without departing from the scope of the invention, it is intended that all matter contained herein be interpreted as illustrative of the invention and not in a limiting sense.

I claim:

1. A joint for easily connecting and disconnecting extrusion members for forming a ceiling grid, the joint comprising in combination, (a) a first extrusion member having a vertical web extending longitudinally having spaced apertures therethrough, a first pair of vertically spaced laterally extending flanges opposite the top and bottom of the web extending away from one side of the web coextensive with the length of the web and a second pair of vertically spaced laterally extending flanges at the top and bottom of the web extending away from the side of the web in a direction opposite the first pair of flanges and coextensive with the length of the web, one lip extending vertically from each flange towards the opposite flange along the length of each flange spaced a predetermined distance from the web to define two pairs of vertically aligned width channels between the lips and the web on both sides of the web, at least two lips secured to the flanges extending from the bottom of the web being secured intermediate the side edges of the flanges to which it is secured and the web whereby the two flanges secured to the bottom of the web carry two coplanar support flanges extending laterally from the web beyond the width of the two channels on both sides of the web; and, (b) a second modified extrusion member having a vertical web extending longitudinally, having spaced apertures therethrough, a first pair of vertically spaced laterally extending flanges at the top and bottom of the web extending away from one side of the web coextensive with the length of the web and a second pair of vertically spaced laterally extending flanges at the top and bottom of the web extending away from the side of the web in a direction opposite the first pair of flanges and coextensive with the length of the web, one lip extending vertically from each flange towards the opposite flange along the length of each flange spaced a predetermined distance from the web to define two pairs of vertically aligned equal width channels between the lips and the web on both sides of the web, at least two lips secured to the flanges extending from the bottom of the web being secured intermediate the side edges of the flange to which it is secured and the web whereby the two flanges secured to the bottom of the web carry two coplanar support flanges extending laterally from the web beyond the width of the two channels on both sides of the web, the opposite ends of the second modified extrusion member each presenting a longitudinally extending web coplanar with the vertical web, the longitudinally extending web of a height substantially equal to the height of the vertical space between each of the two pairs of vertically spaced flanges of the first extrusion member and of the same thickness as the width of the channels each such longitudinally extending web carrying (i) a centrally disposed locating pin extending longitudinally away from the centre of the leading edge of the web, and (ii) a pair of aligned notches in the top and bottom of the web, each notch being longitudinally spaced from the leading edge by a distance equal to the width of the channels between the lips and the web of the first extrusion member and each notch being of a width and depth substantially equal to the width and the vertical height of the lip of the first extrusion member, the longitudinally extending webs presented at the opposite ends of the second modified extrusion member extending a distance to be secured in one of the spaced apertures of the first extrusion members whereby when the joint is formed by inserting the locating pin in an aperture through the vertical web of the first extrusion member and rotating the second modified extrusion member to align the vertical web of said member vertically parallel with the vertical web of the first extrusion member, the longitudinally extending web carrying the locating pin fills the vertical height and lateral width of the channels formed between the lips and the web of the first extrusion member, with the pair of notches in the web carrying the locating pin receiving the lips of the first extrusion member, and the weight of the first extrusion member and the second modified extrusion member in the joint formed is not resting on the locating pin of the second modified extrusion member (and whereby the second extrusion member may be secured simultaneously to two first extrusion members).

2. The joint of claim 1, wherein the longitudinally extending web carrying the locating pin is coextensive with the web of the second modified extrusion member and extends from both ends of such web.

* * * * *